US009247856B2

(12) United States Patent
Colangelo

(10) Patent No.: US 9,247,856 B2
(45) Date of Patent: Feb. 2, 2016

(54) EXTENDABLE SWIVEL HANDLE FOR A DUSTER

(71) Applicant: Joseph M Colangelo, Boca Raton, FL (US)

(72) Inventor: Joseph M Colangelo, Boca Raton, FL (US)

(73) Assignee: EZ PRODUCTS OF SOUTH FLORIDA, L.L.C., Boca Raton, FL (US)

( * ) Notice: Subject to any disclaimer, the term of this patent is extended or adjusted under 35 U.S.C. 154(b) by 0 days.

(21) Appl. No.: 13/962,756

(22) Filed: Aug. 8, 2013

(65) Prior Publication Data

US 2015/0040334 A1 Feb. 12, 2015

(51) Int. Cl.

| | |
|---|---|
| ***A47L 13/38*** | (2006.01) |
| ***B25G 1/04*** | (2006.01) |
| ***B25G 3/38*** | (2006.01) |

(52) U.S. Cl.

CPC . *A47L 13/38* (2013.01); *B25G 1/04* (2013.01); *B25G 3/38* (2013.01)

(58) Field of Classification Search

CPC ..... B25G 3/38; B25G 1/06; B25G 1/04; A46B 5/0054; A46B 5/0075; A46B 5/0079

USPC ..... 15/144.1, 144.4; 403/78, 83–84, 91–93, 403/103–104

See application file for complete search history.

(56) References Cited

U.S. PATENT DOCUMENTS

| | | | | |
|---|---|---|---|---|
| 2,446,401 | A * | 8/1948 | Ziskind | 15/121 |
| 5,794,302 | A * | 8/1998 | Lin | 15/172 |
| 6,625,837 | B2 * | 9/2003 | Jiang | 15/105 |
| 7,055,204 | B2 * | 6/2006 | Ajluni | 15/121 |
| 7,600,287 | B1 * | 10/2009 | Moore et al. | 15/144.4 |

* cited by examiner

*Primary Examiner* — Laura C Guidotti

(74) *Attorney, Agent, or Firm* — Smith Resley Tempel Santos LLC; Gregory Scott Smith

(57) ABSTRACT

A duster or cleaning element holder that includes a duster head that can be mounted on the end of a handle and then rotated relative to the handle. The duster head can be swiveled to the left or to the right, either at certain angles or in a complete 360 degree rotation. The handle may include a telescoping feature to allow the handle to be lengthened to reach hard spaces or retracted for storage.

5 Claims, 13 Drawing Sheets

EXTENDABLE SWIVEL HANDLE FOR A DUSTER

BACKGROUND

Whether you are a homeowner and just needing assistance keeping the dust and grime in check in your own abode, or if you are a member of commercial office/residential cleaning team, you have certain things in common. First of all, you want your job to be as quick and easy as possible without compromising the quality of the cleaning job being performed. Secondly, you want to minimize the amount of equipment that you must maintain, keep in stock, and cart all over the house, or all over the city. As such, devices that offer versatility of use can be quite appealing to such persons.

A few of the wide variety of cleaning situations that one faces can include tight spaces in which the cleaning person has little room to work, low spaces requiring the user to bend down low, and high spaces requiring the user to either stretch up, use a stepping stool, chair or ladder to reach the high spots.

Cleaning a room, home or office may result in having to clean a variety of surfaces that are at varying angles and at varying angles relative to the person cleaning the surface. For example, cleaning the top surface of a shelf, cabinet, picture frame, ceiling fan, etc., is a difficult angle for a typical cleaner. The user must use a ladder to get their reach above the surface, or proximate to the surface before they can adequately wipe the surface. Another common situation is when trying to wipe the underside surfaces of items, such as under a piece of furniture to remove cobwebs and spider webs, the top surface of books under a lower shelf, etc. Another tricky situation is when trying to dust or wipe behind items sitting on a shelf at varying elevations.

What is needed in the art is a versatile device that can be used with a variety of dusting and cleaning pads, and that is adjustable such that it is a suitable tool for any of the above, as well as other scenarios.

BRIEF SUMMARY

Embodiments of a duster holder that is adjustable in one or more ways. In one embodiment, the duster holder includes a duster head that can be rotated relative to the handle. For instance, in one embodiment the duster head can be swiveled to the left or to the right, either at certain angles or in a complete 360 degree rotation. Such embodiments allow the duster head to be moved laterally with respect to a handle. In other embodiments, the duster head can rotate or swivel up and down. In either of these embodiments, the duster head can be moved from a parallel or fully extended position, to perpendicular position to folded under position. In yet other embodiments, the duster head may be able to be swiveled both left and right as well as up and down by including two swivel joints.

Embodiments presented herein disclose a locking swivel joint that allows a duster holder to be pivotally joined with a base that connects to a handle. In one embodiment, the locking swivel joint includes a spring loaded release button which when actuated, allows the user to swivel or rotate the duster holder to a new position.

Embodiments also include and extendable and retractable handle. The handle can include two or more telescoping poles that can be slid inside of each other in a retracted state, and then extended out to lengthen the duster holder. A variety of mechanisms can be used to secure the poles in the extended or retracted positions, one such technique being a twisting lock mechanism interior to the poles.

These and other embodiments, aspects, elements and features will be described in more detail in the detailed description section.

DETAILED DESCRIPTION OF VARIOUS EMBODIMENTS

The present disclosure presents various embodiments, as well as features, aspects and functions of a duster holder. Various embodiments of the duster holder may include an extendable arm feature as well as a swiveling head feature. It will be appreciated that while the present disclosure presents such embodiments, features, aspects and functions, they are presented simply to provide an overall understanding of how the extendable duster handle can be embodied. Further, it will be appreciated then that not all potential embodiments of the extendable duster handle are presented within the confines of this description and, not all of the features, aspects and functions presented are required in all of the various embodiments.

Turning now to the figures in which like elements are presented by like labels throughout the various view, exemplary embodiments of the extendable duster handle are presented.

Figures 1A, 1B:
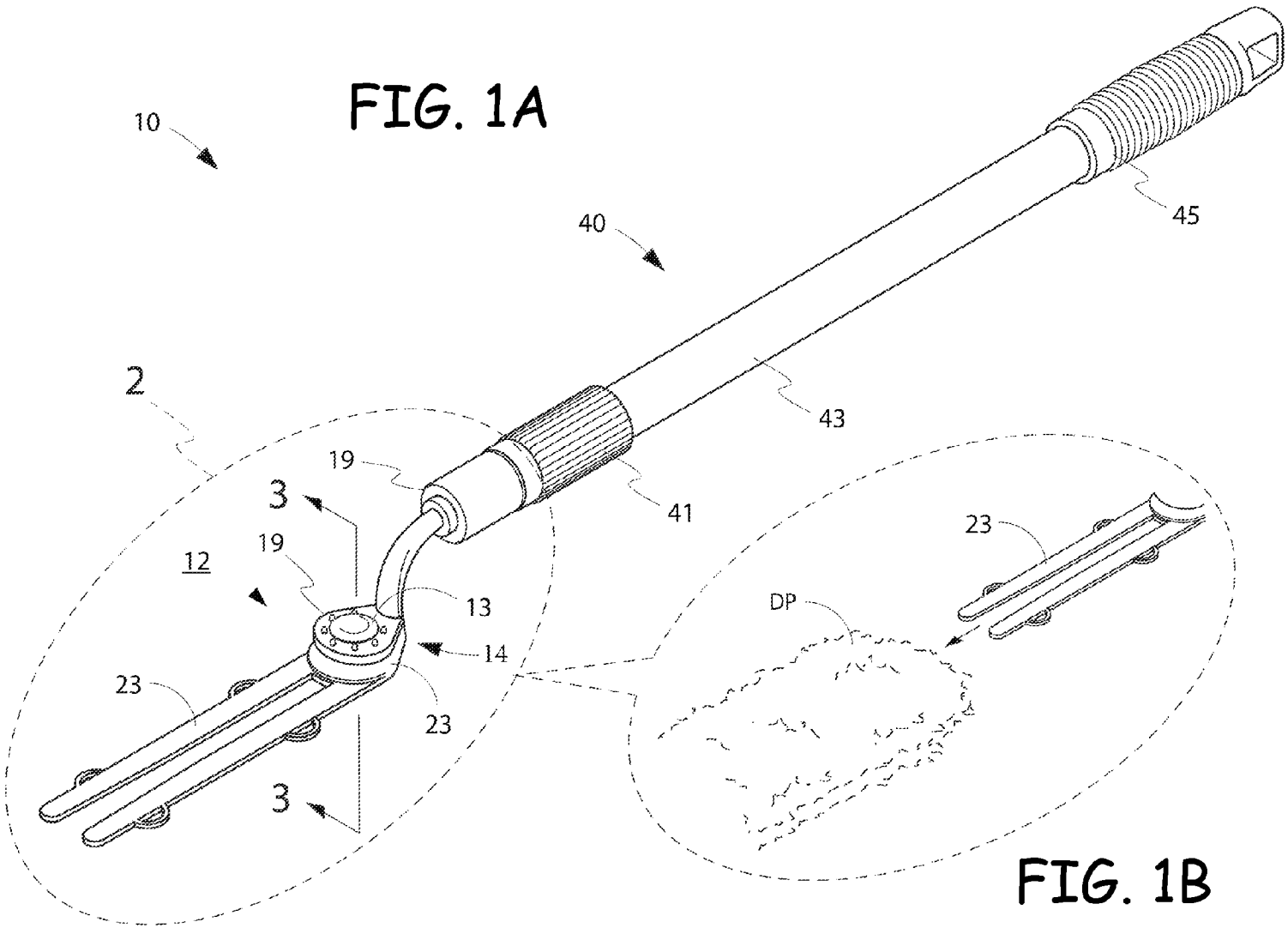
FIG. 1A is a perspective view of one potential embodiment of the duster holder.
FIG. 1B is a magnified view of the duster support 23 interfacing to one example of a duster pad DP.

FIG. 1A is a perspective view of one potential embodiment of the duster holder. The duster holder 10 is shown as including an arm element 40 and a head element 12. The arm element 40 includes a grip handle 45 on one end of a main arm element 43 and the head element 12 is attached to the opposing end of the arm element 40.

Juxtaposed with the head element 12 at the end of the main arm element 43 distal from the grip handle 45 is a lock grip 41 that is used to assist in the opening or closing of a locking mechanism that allows the arm 40 to telescope between an extended or retracted position.

The head element 12 includes a base 19 and a duster support 23. The base 19 includes two ends with one end including an interface that is used to secure the head element 12 to the end of the arm element 40. The other end of the base 19 includes a flat disk-like element that is illustrated as being joined to the arm interface by a short curving finger.

The duster support 23 is illustrated as including prongs for insertion into a duster. Although the duster support 23 is illustrated as including two prongs with spring holders, a variety of duster pad interfaces may be used in the various embodiments. IN fact, the entire head element 12 can be removed and replaced by a different head element and, the head element 12 can be interfaced to a different style arm element 40. However, the present embodiments are described, but not limited, as including a flat, two-pronged styled duster pad support.

The prongs are joined together by an inverted bowl on the end of the duster support 23. The inverted bowl corresponds to the underside of the flat disk-like element of the base 19.

The duster support 23 is joined to the base 19 by a locking swivel joint 14. The locking swivel joint, which is presented in more detail in FIG. 2 and FIG. 3, includes a spring-loaded release button 13 which allows the base 19 and the duster support 23 to rotate about an axis that passes through the joint of the inverted bowl of the duster support 23 and the flat disk-like element of the base 19.

FIG. 1B is a magnified view of the duster support 23 interfacing to one example of a duster pad DP. In the illustrated embodiment, the duster support 23 includes two prongs which are slid into an interior cavity or sleeve of the duster DP. In other embodiments more or less than two prongs may be utilized. For instance, a single rod or prong may be used and slid into a 360 degree duster head. In other embodiments, the duster support may be configured to support a dust mop style head and as such, may include multiple prongs, wider prongs or some other mechanical interface to a dusting head. It should be appreciated that these examples are only for the purpose of understanding the various embodiments and are not provided in a limiting manner.

Figure 2:
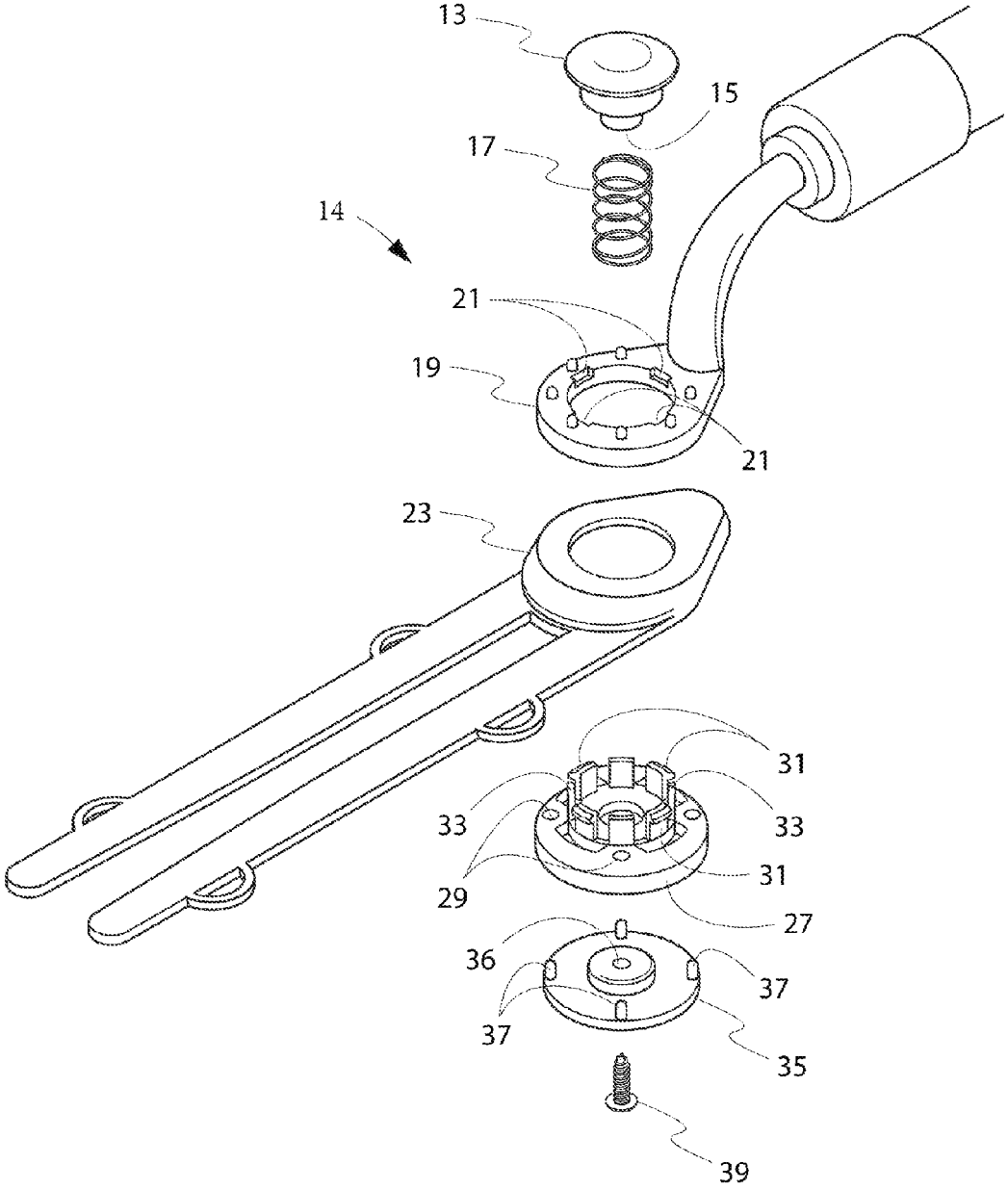
FIG. 2 is an exploded perspective view of the locking swivel joint 14 of FIG. 1A.
Figure 3:
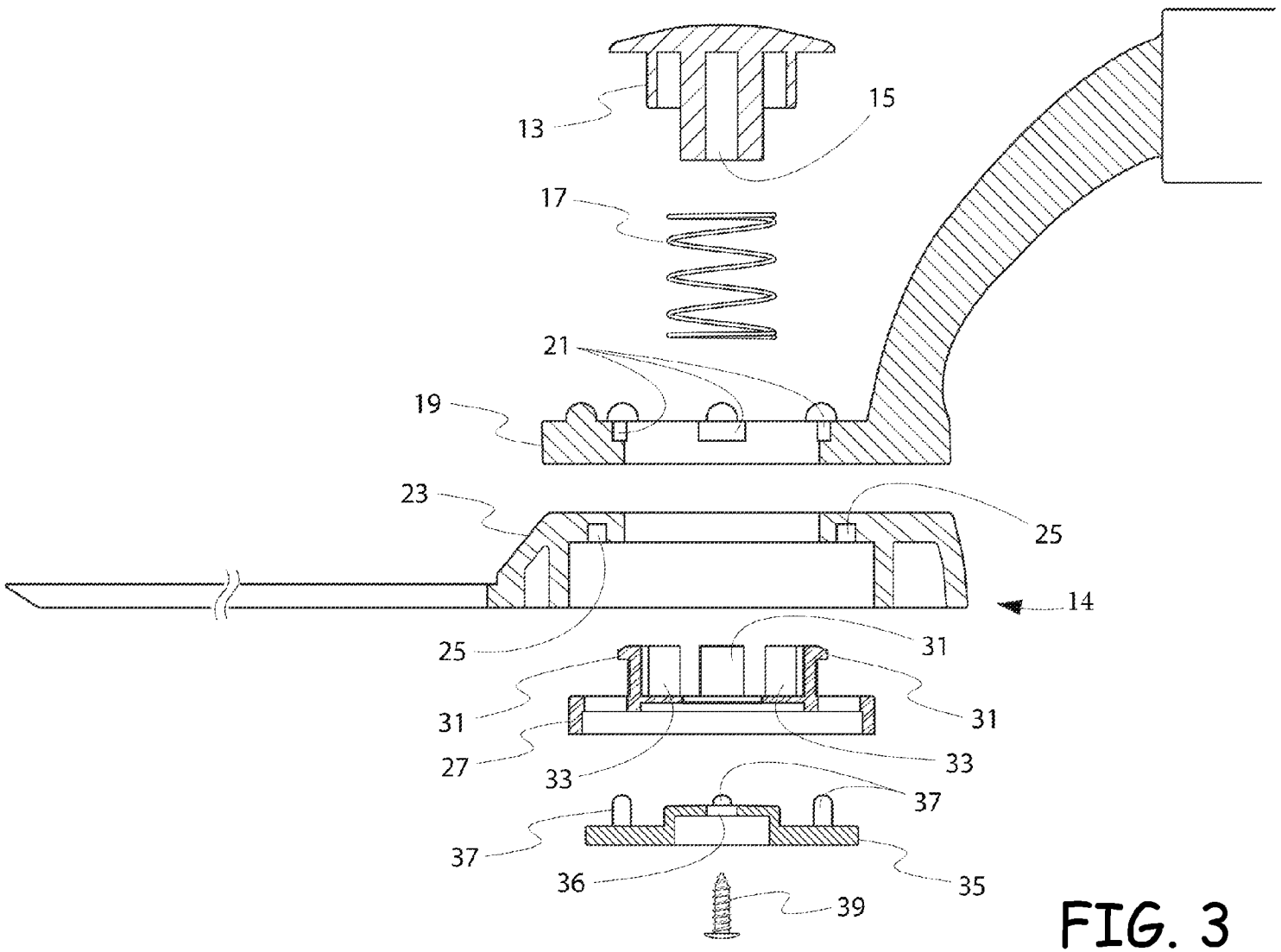
FIG. 3 is a cross-sectional exploded view of the locking swivel joint 14 of FIG. 1A taken at view 3.

FIG. 2 is an exploded perspective view of the locking swivel joint 14 of FIG. 1A. FIG. 3 is a cross-sectional exploded view of the locking swivel joint 14 of FIG. 1A taken at view 3. In general, the locking swivel joint 14 is an assembly that includes the base 19 and the duster support 23 as integral components and, allows the duster support 23 to swivel about an axis that passed through the center of the inverted bowl of the duster support 23 and the flat disk-like element of the base 19. More specifically, the locking swivel joint assembly 14 includes the spring-loaded release button 13 that is placed on the top of the assembly. Below the spring-loaded release button 13 is a spring 17. Extending down from and under the spring-loaded release button 13 is protrusion 15. The protrusion 15 defines a hole that does not extend all the way through the spring-loaded release button 13 but rather, is suitable for receiving a screw 39. The protrusion 15 is coaxially positioned within the coil of the spring 17. A round plate 35 is positioned below the assembly and includes an aperture 36 that extends through the plate 35 and a plurality of upward facing protrusions 37 around the peripheral edge of the round plate 35. Sandwiched between the spring-loaded release button 13 and the round plate 35, from top to bottom is the flat disk-like element of the base 19, the inverted bowl of the duster support 23 and a locking disk 27.

One function of the locking disk 27 is to hold the base element 19 and the duster support 23 together. Another function of the locking disk 27 is to provide swivel-locking positions for the locking swivel joint 14. A third function of the locking disk 27 is to receive a bottom side of the spring 17. The locking disk 27 includes a circular disk with a centrally located hole. Surrounding the hole is a number of vertical support elements 33 and vertical locking elements 31. The vertical support elements 33 and the vertical locking elements 31 are forced through an aperture in the inverted bowl of the duster support 23 and the locking teeth of the vertical locking elements 31 are forced through another aperture of the flat disk-like element of the base element 19 and into notches 21. This mechanism secures the locking disk 27, the duster holder 23 and the base element 19 together as a joined assembly. However, once joined in such a manner, the based element 19 and the duster holder 23 are free to swivel a full 360 degrees about a central axis. The vertical support elements 33 and 31 surround a surface of the locking disk 27 that is suitable for receiving the bottom surface of the spring 17.

The screw 39 is then placed up from the bottom of the assembly through the aperture 36 of round plate 35, coaxially through in the locking disk 27, the inverted bowl of the duster support 23, the flat disk-like element of support element 19 and spring 17. The end of the screw is secured into the hole in protrusion 15 such that the entire assembly is jointed together and the protrusion 15 of the spring-loaded release button 13 rest against the upper surface of the round plate 35.

Once the locking swivel joint is secured together with screw 39, the spring 17 is compressed and applies upward pressure to the spring-loaded release button 13 and downward pressure against the locking disk 27. The screw 39 passes freely through each of the components of the assembly with the exception of the round plate 35 which as an aperture large enough for the screw 39 to freely pass through up to the head of the screw 39. As such, the round plate 35 is secured to the spring-loaded release button 13 such that when the spring-loaded release button 13 is pressed downward, the round plate 35 moves downward as well. When the spring-loaded release button 13 is released, the spring 17 forces the spring-loaded release button 13 in an upward direction as the spring 17 is coiled against a non-moving surface of the locking disk 27. The round place 35 naturally moves upward along with the spring-loaded release button 13 as they are affixed to each other with screw 39.

Operation of the Locking Swivel Joint

The locking swivel joint allows the duster support 23 to swivel relative to the base element 19 into one of a plurality of positions and then to be locked into a selected position. When the locking swivel joint 14 is in a steady state (defined as a state in which the device can be used and the spring-loaded release button 13 is not being actuated), the spring 17 forces the spring-loaded release button 13 upwards and the round disk 35 is pulled in the same direction. Each of the protrusions 37 on the upper face of the round disk 35 are pulled into one of the receiving holes 25 formed in the underside face of the inverted bowl of the duster support 23. The protrusions 37 being pulled into the holes 25 prevent the duster support 23 from swiveling and thus, the duster holder 10 can be used to dust a surface.

To swivel the duster holder 23, the spring-loaded release button 13 is pressed downward thereby causing spring 17 to compress. The round disk 35 which is affixed to the underside of the spring-loaded holder 23 traverses through the interior of the inverted bowl of the duster holder 23 a distance sufficient for the protrusions 37 to fully exit the holes 25 of the duster holder 23. In this actuated transitional state, the duster holder 23 can be swiveled around an axis that extends through the locking swivel joint 14 assembly.

When the spring-loaded release button 13 is released, the protrusions 37 are forced against the underside of the inverted bowl of the duster support 23. If the protrusions 37 are in alignment with the holes 25, the protrusions 37 are forced into the holes and the assembly is locked in place to prevent further swiveling—steady state. If the protrusions 37 are not in alignment with the holes 25, the duster support 23 can be further swiveled until the protrusion 37 come into alignment with the holes 25 and then the round disk 35 will be pulled upwards thereby securing the locking swivel joint 14 into a steady state position.

Figure 4A:
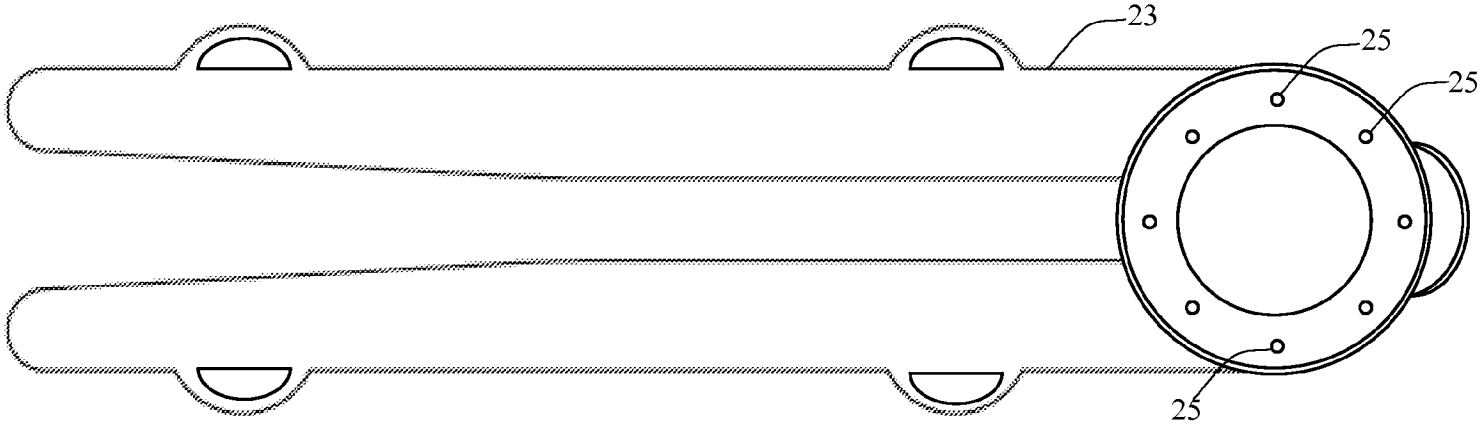
FIG. 4A is an underside view of the duster support 23 illustrating details of the bottom side of the inverted bowl of the duster support 23.
Figure 4B:
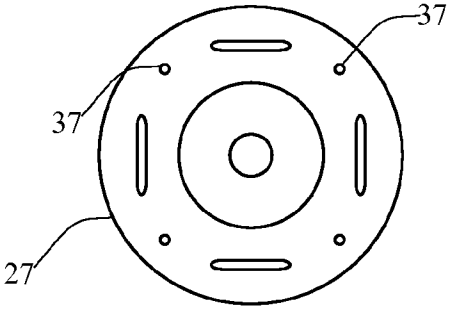
FIG. 4B illustrates a top view of the locking disk 27 that includes four apertures 29.

FIG. 4A is an underside view of the duster support 23 illustrating details of the bottom side of the inverted bowl of the duster support 23. A ring of holes 25 about a center axis of the inverted bowl is shown and as illustrated, includes 8 such holes. FIG. 4B illustrates a top view of the locking disk 27 that includes four apertures 29. As shown best in FIG. 2, the round disk 35 includes four protrusions 37. When assembled, the four protrusions 37 extend through the four holes of the locking disk 27 and when aligned, into four of the eight holes in the underside of the inverted bowl of the duster support 23. With eight holes in the underside of the inverted bowl, the duster support 23 can be secured into 8 discrete positions.

Figure 5:
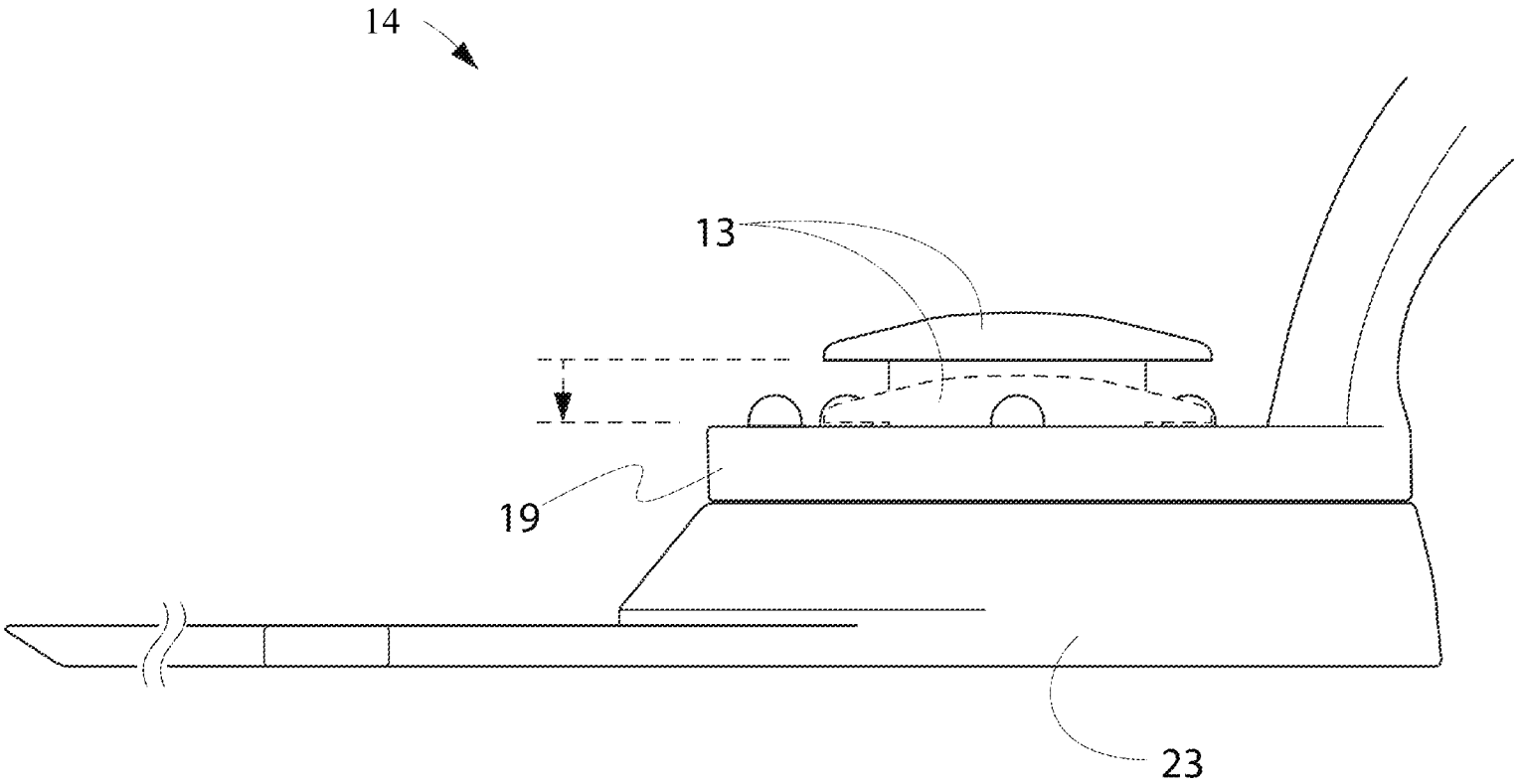
FIG. 5 is a side view of portions of the duster support focusing on the locking swivel joint 14.

FIG. 5 is a side view of portions of the duster support focusing on the locking swivel joint 14. The spring-loaded release button 13 is illustrated in a steady state position and the dotted lines illustrate the position of the spring-loaded release button 13 when actuated or depressed and the distance that the button travels when actuated.

Figure 6A:
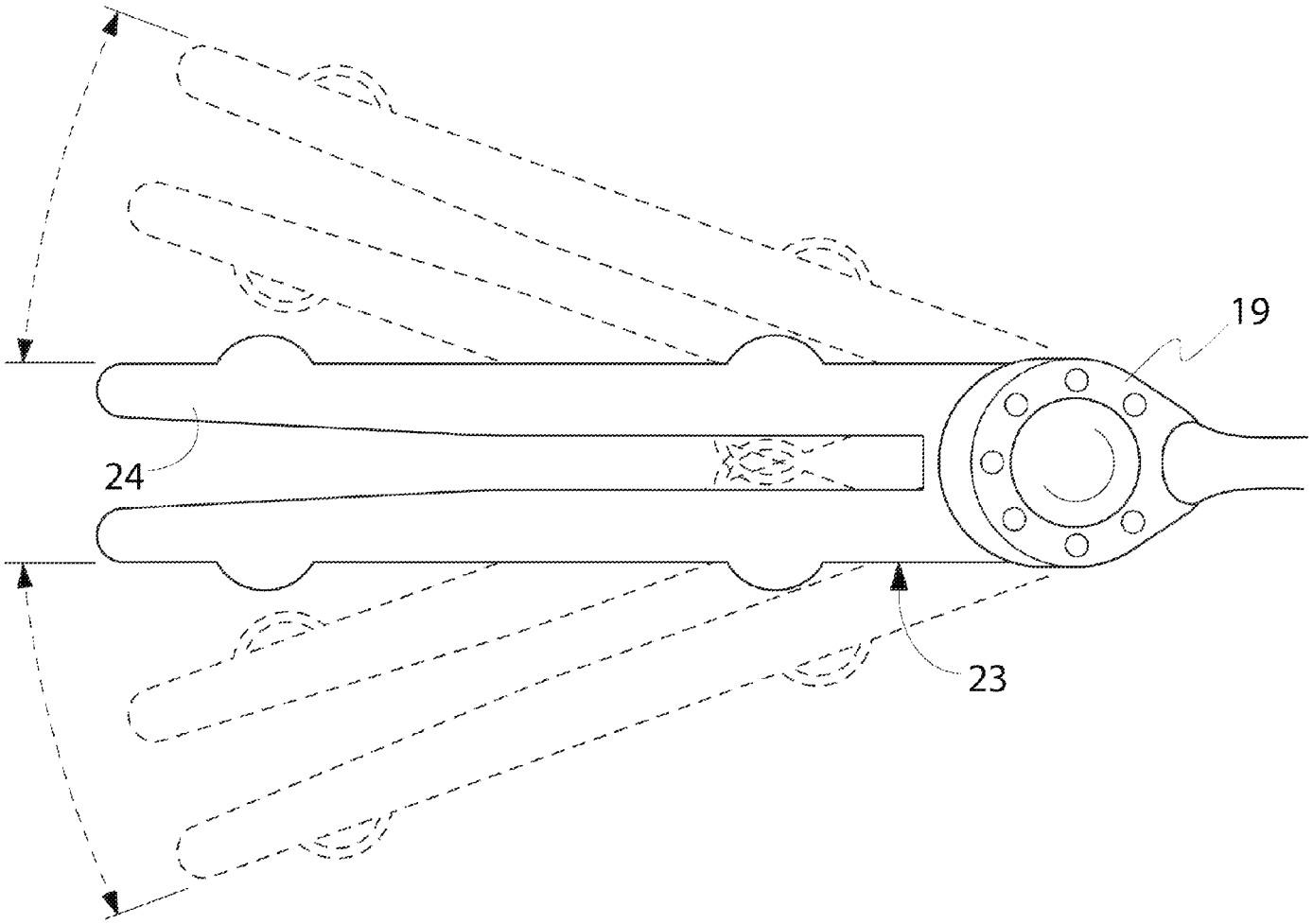
FIG. 6A is a state diagram illustrating the movement of the duster support 23 when being swiveled.

FIG. 6A is a state diagram illustrating the movement of the duster support 23 when being swiveled. In the illustrated embodiment, the duster support 23 can be moved to 8 discrete positions with the position of the solid prongs in FIG. 6A being considered the fully extended or twelve o'clock position. In the fully retracted position, or six o'clock, the duster holder 10 is suitable for storage, packaging or in certain applications clean. Any of the other positions between the fully extended and fully retracted position may be utilized for various applications. It will be appreciated that although eight positions are illustrated, in other embodiments more or fewer positions may utilized.

The embodiment illustrated in the figures is shown as including a head with a duster support 23 that swivels laterally with respect to the arm element 40. However, it will be appreciated that other embodiments are also anticipated. As another non-limiting example, rather than a curving finger extending from the base 19 to the duster holder 23, a straight finger or shaft may be used. Further, the duster support 23, rather than being laterally oriented with the arm element 40, the prongs of duster support 23 may be rotated ninety degrees relative to the locking swivel lock 14. In this embodiment, rather than the duster support 23 swiveling laterally with respect to the arm element 40, the duster support 23 swivels up and down.

Although the swivel locking assembly 14 has been described as the spring-loaded release button being on "top", it is thus appreciated that in the afore described embodiment, the spring-loaded release button may be located on the right or left side and then be depressed or actuated in a lateral manner to move the swivel lock mechanism 50 from steady state to its transitional state.

Figure 9:
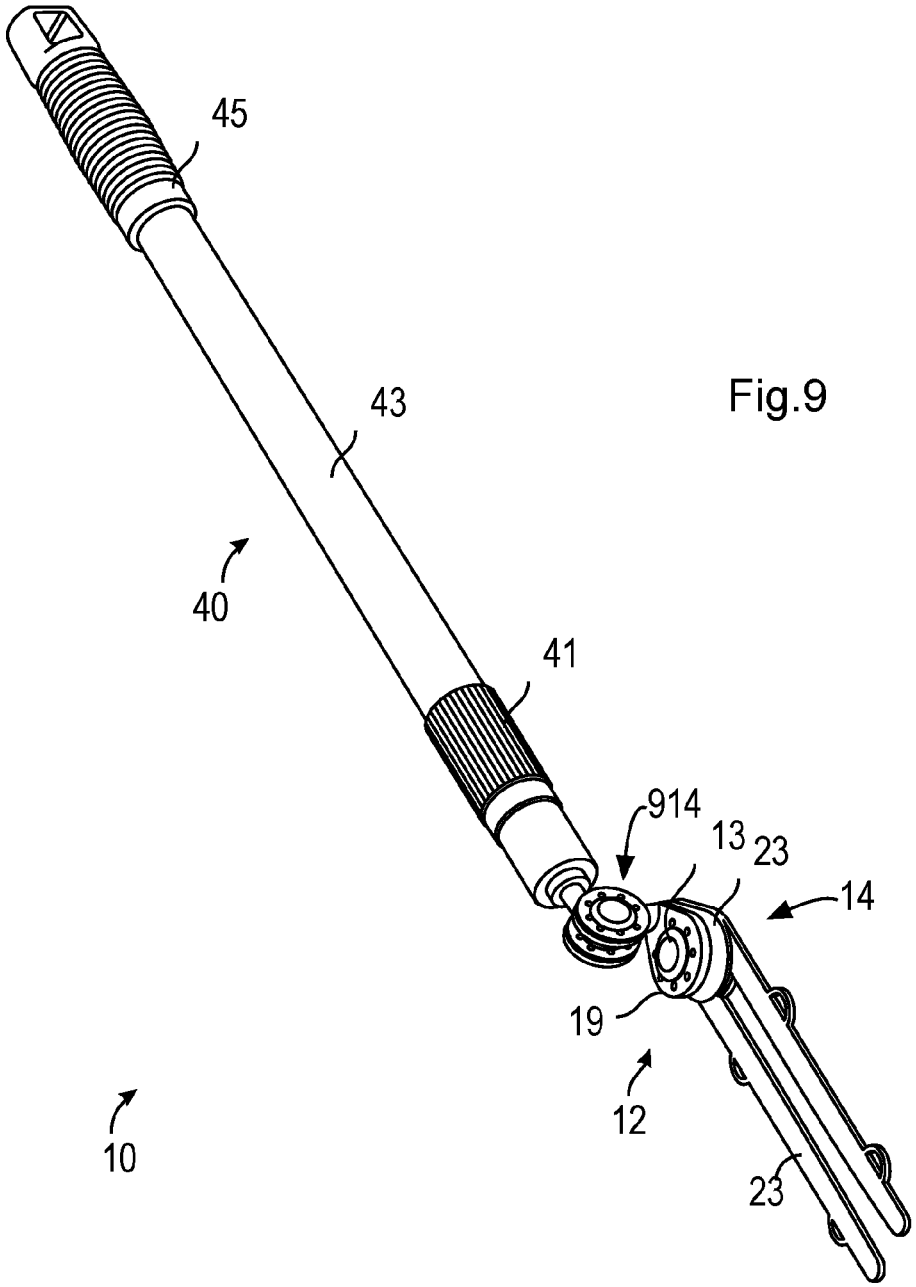

It should also be appreciated that more than one swivel locking mechanism 14 may be utilized in some embodiments (see FIG. 9). For instance, one swivel locking mechanism 14 may be laterally oriented and allow the duster support to swivel laterally (left and right) while a second swivel locking mechanism 914 may be vertically oriented and allow the duster support to swivel up and down. In such embodiments, it will be appreciated that the duster pad can be located in a wide variety of positions and orientations for cleaning purposes.

In addition, the swivel lock 14 has been described as including 8 discrete positions. It should be appreciated than the number of positions can be increased or decreased in various embodiments. Thus, more or less discrete positions can be created for the duster support 23. Further, in some embodiments rather than using protrusion pins 37 to align with holes 25, a series of upper and lower teeth may be used to more easily enable more discrete positions. Further, rather than utilizing upper and lower teeth, the upper surface of the round disk 35 may be frictional with the lower surface of the locking disk 27 such that rather than pins that protrude through the locking disk 27 and into the holes 25, the friction of the round disk 35 against the locking disk 27 is sufficient to hold the duster support in a steady state.

Further, in another embodiment the round disk may include teeth along its perimeter similar to a gear. Further the interior wall of the inverted bowl may have corresponding teeth such that when the teeth and gaps of the round disk 35 align with gaps and teeth of the inverted bowl, the duster support 23 can be locked into a steady state position.

Similarly, rather than teeth along the edge of the round disk 35 and wall of the inverted bowl, the inverted bowl can be tapered such that when the spring-loaded release button 13 is released, the friction of the round disk 35 against the inner wall of the inverted bowl is sufficient enough to hold the duster support 23 into a fixed discrete position.

Although the embodiments presented herein are focused on a handle combined with the duster support, it should be appreciated that the duster header in and of itself may be a product that can be individually sold without the handle. For instance, a universal or common interface may be included on the base end of the header device to allow the header device to be mounted to a variety of sticks, rods or other objects. For example, the base of the head may include a threaded socket to receive a threaded connector on the end of a broom or mop handle. Other embodiments may include a cap cover that can be slid over a pole, rod or stick handle.

Figure 6B:
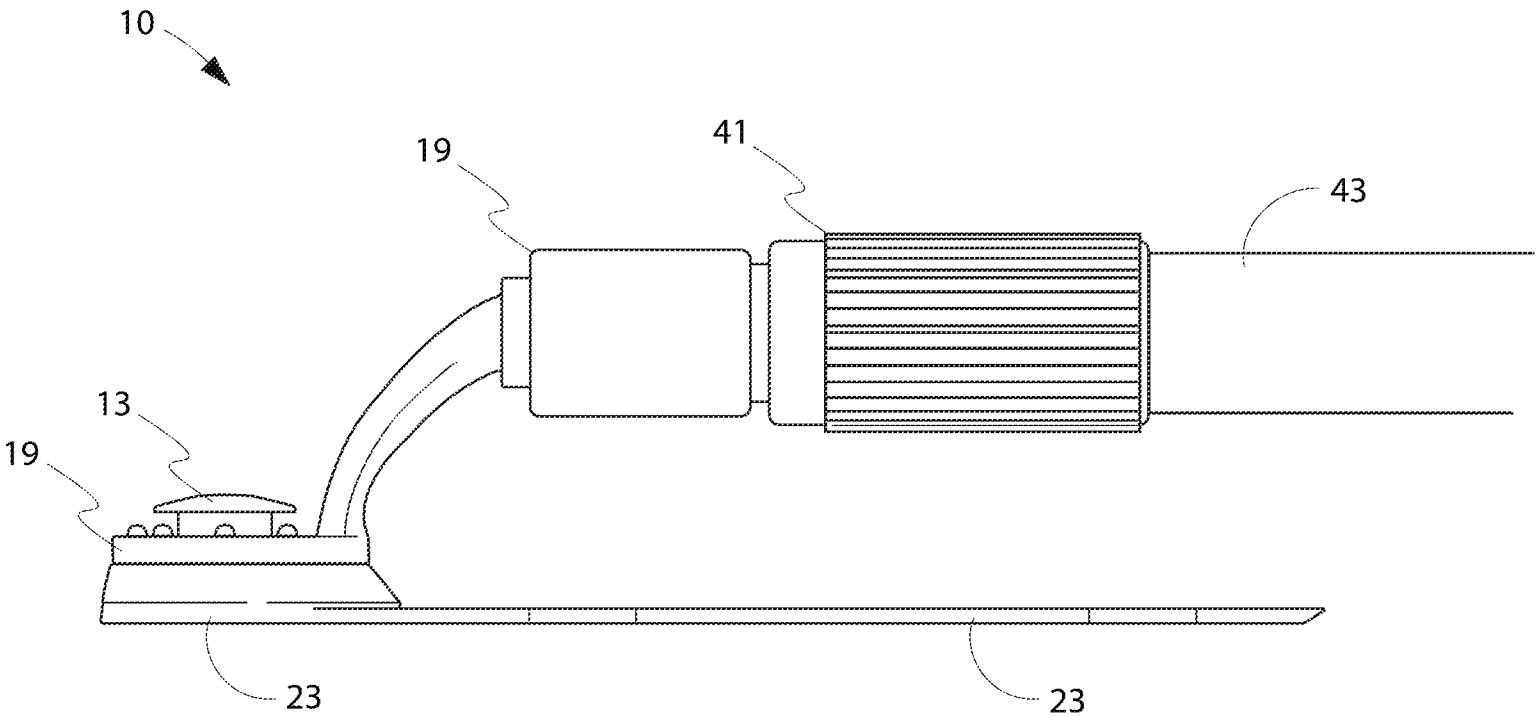
FIG. 6B is a side view of the front portion of the duster in the retracted position with the duster support being swiveled 180 degrees from the front.

FIG. 6B is a side view of the front portion of the duster in the retracted position with the duster support being swiveled 180 degrees from the front. In the illustrated embodiment, the duster support 23 has been swiveled completely under the arm element 40 which places the duster into a storage mode or a cleaning mode. In this state for cleaning, the duster can be slid under a surface and when the surface comes in contact with the curving finger of the base 19, movement of the duster 10 is stopped and the user can push the duster in the other direction. However, the illustrated mode is also convenient for storage and packaging of the device.

Locking Extendable Arm

Figures 7A, 7B:
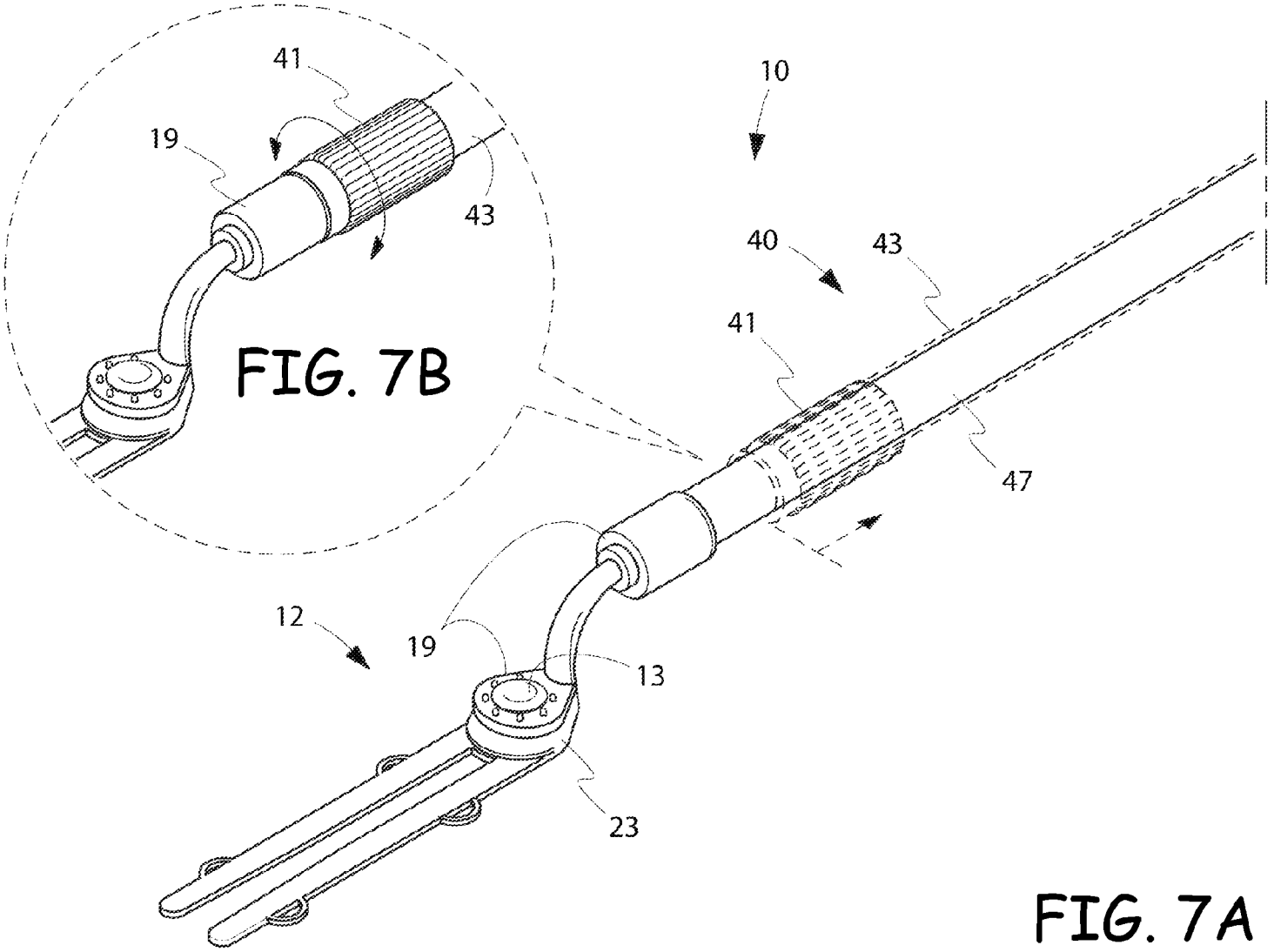
FIG. 7A is a perspective view of the duster holder 10 of FIG. 1 illustrating an expandable feature of the arm element.
FIG. 7B is a focused view of the arm element 40 in the fully retracted position.

FIG. 7A is a perspective view of the duster holder 10 of FIG. 1 illustrating an expandable feature of the arm element. The arm element 40 includes an outer bar 43 and an inner bar 47. The lock grip 41 is placed over one end of the outer bar 43 and the handle grip 45 is placed over the other end of the outer bar 43. The inner bar 47 telescopically slides in and out of the outer bar 43 and a locking mechanism can be used to lock the relative position of the inner bar 47 and the outer bar 43 at a desired position. To unlock the locking mechanism, a user can grasp the lock grip 41 and then twist or rotate the inner bar 47 clockwise to unlock the locking mechanism and counter clockwise to lock the locking mechanism.

Figure 7C:
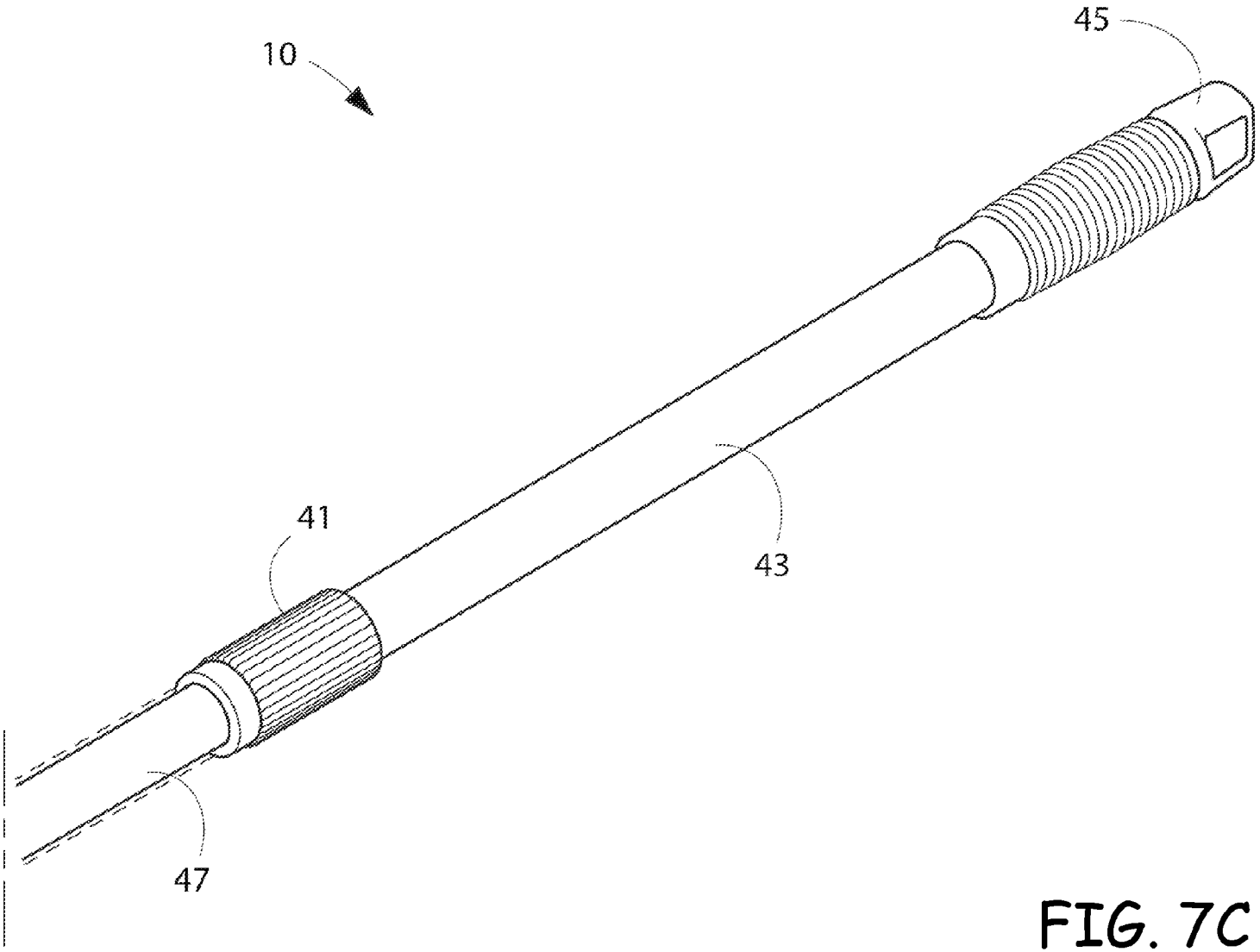
FIG. 7C is a perspective view illustrating the arm element 40 is a partially or fully extended position.

FIG. 7B is a focused view of the arm element 40 in the fully retracted position. The lock grip 41 can be rotated counter clockwise to lock the inner bar 47 and the outer bar 43 into this position. Rotating the lock grip 41 clockwise releases the locking mechanism and allows the inner bar 47 to be refracted from the outer bar 43. FIG. 7C is a perspective view illustrating the arm element 40 is a partially or fully extended position.

Figure 8A:
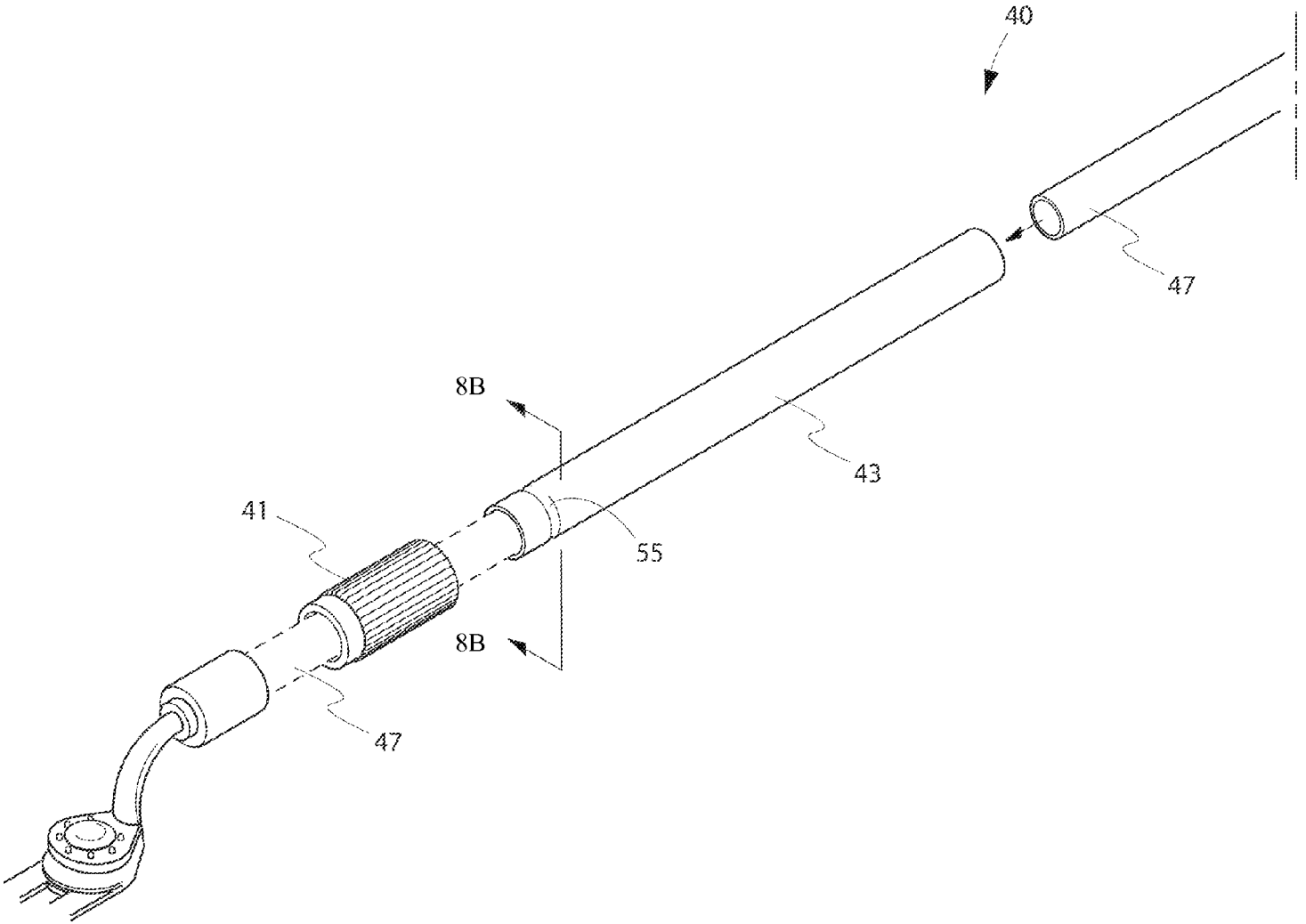
FIG. 8A is an exploded perspective view of the arm element 40.

FIG. 8A is an exploded perspective view of the arm element 40. The head element 12 is illustrated as being adjoined to one end of the inner bar 47. The inner bar 47 is initially inserted through the handle grip end of the outer bar 43, and traverses through the outer bar 43 until the end emerges from the lock grip end of the outer bar 43. The lock grip 41 can then be placed over the end of the outer bar 43 and snapped and held in place by detents 55. The end of the inner bar 47 emerging from the lock grip end of the outer bar 43 is adjoined to the header element 12.

Figure 8B:
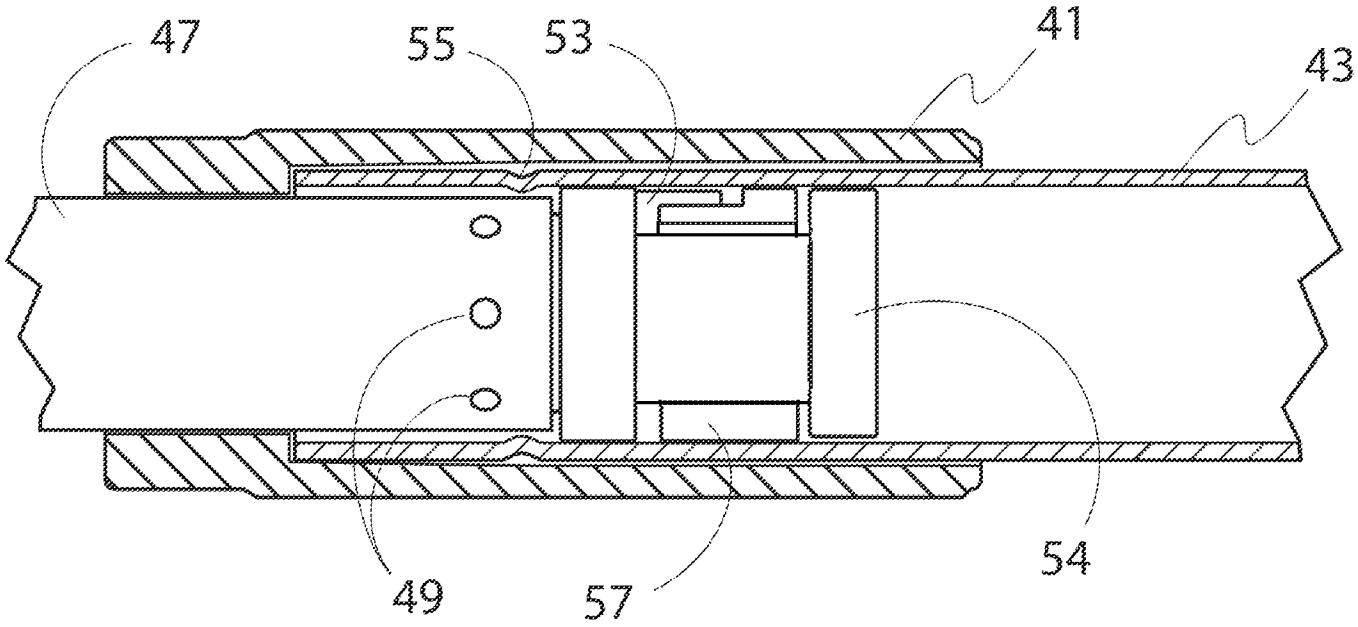
FIG. 8B is a cross-sectional view taken a view 8B in FIG. 8A showing details of an exemplary locking mechanism.
Figures 8C, 8D:
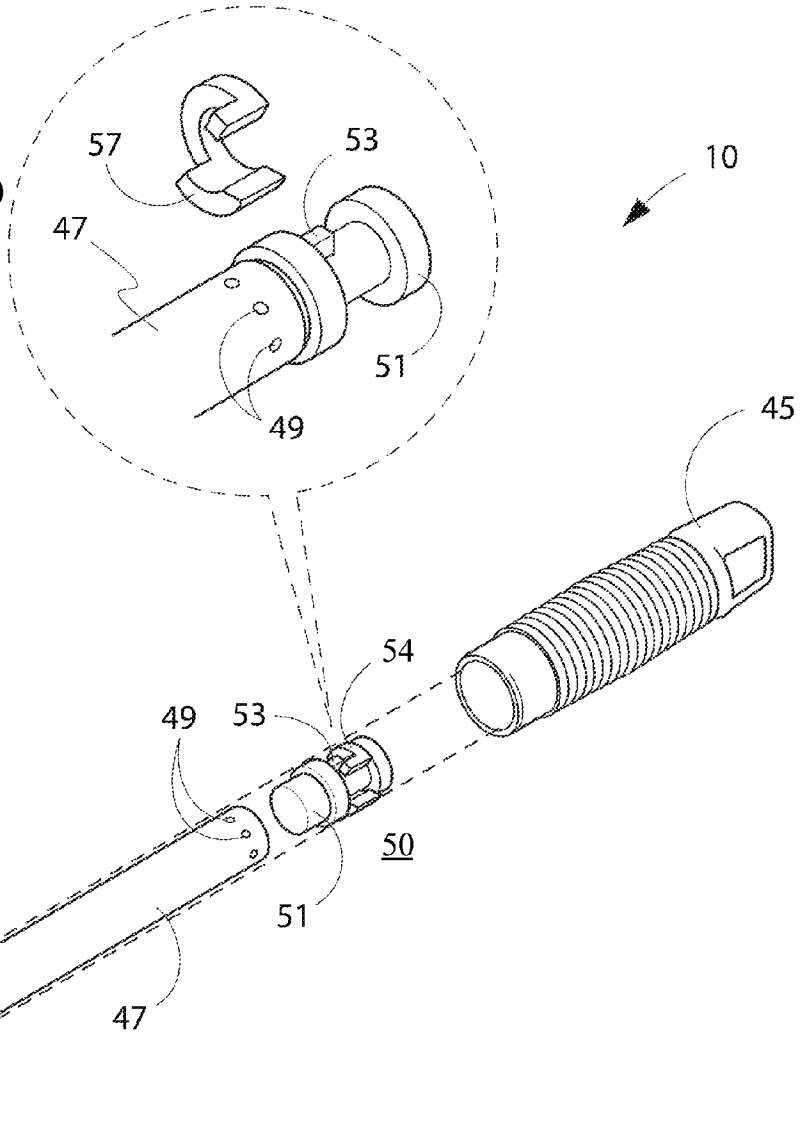
FIG. 8C is a perspective view of an exemplary locking mechanism.
FIG. 8D is a magnified and exploded view of the exemplary locking mechanism and FIG. 9 is a perspective view of an alternative embodiment.

FIG. 8B is a cross-sectional view taken a view 8B in FIG. 8A showing details of an exemplary locking mechanism. FIG. 8C is a perspective view of an exemplary locking mechanism. FIG. 8D is a magnified and exploded view of the exemplary locking mechanism. The locking mechanism 50 includes a mount 51, a stop 53, a shaft 52, a cap 54 and a rotating latch 57. The mount 51 is sized to fit into the interior of inner bar 47. To secure the locking mechanism in place, one or more detents 49 can be used to pinch hold the mount 51 of the locking mechanism 50. The rotating latch 57 is placed over the shaft 52 in such a way that the stop 53 is on the same side as the catch 58. The thickness of the rotating latch 57 varies from a first end to the catch 58 end by increasing in thickness over this progression. The shaft 52 is cylindrical but, is slightly off center such that the distance from the outer diameter of the cap 54 to the outer diameter of the shaft 52 is greater proximate to the stop 53 than it is on the opposing side.

In illustrating the operation of the extendable and locking arm, it is assumed that the arm element 10 is initialed in a fully retracted and locked position. To unlock the arm and extend the arm element, a user may grasp the lock grip 41 and rotate the outer bar 41 in a counter clockwise direction to release the locking mechanism 50. Once the locking mechanism 50 is released, the inner bar 47 can be slid out of the outer bar 43 in a telescoping manner to lengthen the arm element 10 to a desired length. Once the desired length is achieved, the user can again grasp the lock grip 41 and rotate it in a clockwise direction to lock the locking mechanism 50.

When the outer diameter is being rotated in a clockwise direction, the shaft 52 rotates within the central area of the rotating latch 57. As the shaft 52 rotates within the rotating latch 57, the area of the shaft 52 that is closest to the outer diameter of the cap 54 moves into correspondence with the thicker portion of the rotating latch 57. The shaft 52 then presses against the thicker portion of the rotating latch 57 forcing it into a friction relationship with the inner surface of the outer bar 43 thereby locking the inner bar 47 relative to the outer bar 43.

Although the embodiments presented herein are described as including two poles that telescope with relation to each other, it should be appreciated that more than two bars may also be used to either allow the arm to extend further when being used or, to allow the device to be retracted to a smaller profile—or both. In addition, rather than a twist lock the various embodiments may also include or alternatively include other locking mechanisms such as pins spring loaded buttons, etc.

In some embodiments, the locking swivel joint may be small enough such that the duster holder can be refracted into the interior of the bar of pipe of the arm element.

According to the present invention, as has been described hereinabove, the position of the support member to which a cleaning wiper is to be attached can be changed with a simple operation. In addition, the support member can be stabilized in predetermined positions without causing unexpected turn.

The present invention should not be understood as limited to the specific embodiments set forth herein but to include all possible embodiments which can be embodied within a scope encompassed and equivalent thereof with respect to the feature set out in the appended claims.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A device for holding a cleaning element, the device comprising:

a handle; and a support member pivotally connected to a front end of the handle by first and second locking swivel joints, the support member being configured to support a cleaning element;

the first locking swivel joint including:

a spring-loaded release button to disengage a locking mechanism and allow the support member to freely pivot laterally relative to the handle; and wherein the locking mechanism comprises a plurality of pins that engage with a subset of a plurality of holes to secure the support member into one of a plurality of positions; and the second locking swivel joint including:

a second spring-loaded release button to disengage a second locking mechanism and allow the support member to freely pivot vertically relative to the handle; and wherein the second locking mechanism comprises a second plurality of pins that engage with a second subset of a plurality of holes to secure the support member into one of a second plurality of positions; and wherein the handle comprises an inner pipe and an outer pipe and the length of the handle can be increased by telescoping the inner pipe out from the outer pipe; and wherein the inner pipe includes a rotating locking mechanism to lock the inner pipe and outer pipe relative to each other; and wherein the rotating locking mechanism comprises:

a cylindrical mount fixed to the end of the inner pipe that telescopes into the outer pipe, wherein the cylindrical mount comprises a cap mounted on a cylindrical shaft with an axis offset from an inner pipe axis, and a stop mounted to the cylindrical shaft; and a latch rotatably mounted about the cylindrical shaft, the latch comprising a thin end configured to engage the stop; and a thick end configured to engage the stop; and wherein the latch tapers in thickness from the thin to thick ends;

such that upon turning the inner pipe, the cylinder engages the latch and moves the cap into a friction relationship with the outer pipe.

2. The device of claim 1, wherein the plurality of holes force the support member into one of eight discrete positions.

3. A swivel head for holding a cleaning element, the swivel comprising:

a base including an interface for receiving a handle;

a support member for receiving the cleaning element;

first and second locking swivel joints for pivotally adjoining the support member and the base;

the first locking swivel joint including:

a spring-loaded release button to disengage a locking mechanism and allow the support member to freely pivot laterally relative to the handle; and wherein the locking mechanism forces the support member into one of a plurality of lateral positions relative to the handle;

and a second locking swivel joint for pivotally adjoining the support member and the base; the second locking swivel joint including:

a second spring-loaded release button to disengage a second locking mechanism and allow the support member to freely pivot vertically relative to the handle; and wherein the second locking mechanism forces the support member into one of a plurality of vertical positions relative to the handle; and wherein the handle comprises an inner pipe and an outer pipe and the length of the handle can be increased by telescoping the inner pipe out from the outer pipe; and wherein the inner pipe includes a rotating locking mechanism to lock the inner pipe and outer pipe relative to each other; and wherein the rotating locking mechanism comprises:

a cylindrical mount fixed to the end of the inner pipe that telescopes into the outer pipe, wherein the cylindrical mount comprises a cap mounted on a cylindrical shaft with an axis offset from an inner pipe axis, and a stop mounted to the cylindrical shaft; and a latch rotatably mounted about the cylindrical shaft, the latch comprising a thin end configured to engage the stop; and a thick end configured to engage the stop; and wherein the latch tapers in thickness from the thin to thick ends;

such that upon turning the inner pipe, the cylinder engages the latch and moves the cap into a friction relationship with the outer pipe.

4. The swivel head of claim 3, wherein the locking mechanism comprises a plurality of pins that engage with a subset of a plurality of holes to secure the support member into one of a plurality of positions.

5. The swivel head of claim 4, wherein the spring-loading release button, when actuated, cause the pins to disengage from the plurality of holes and allows the support member to freely move.

* * * * *